US008184833B2

(12) United States Patent
Demuynck

(10) Patent No.: US 8,184,833 B2
(45) Date of Patent: May 22, 2012

(54) ELECTROSTATIC SPEAKER ARRANGEMENT FOR A MOBILE DEVICE

(75) Inventor: Randolph Cary Demuynck, Wake Forest, NC (US)

(73) Assignee: Sony Ericsson Mobile Communications AB, Lund (SE)

( * ) Notice: Subject to any disclaimer, the term of this patent is extended or adjusted under 35 U.S.C. 154(b) by 1193 days.

(21) Appl. No.: 11/956,367

(22) Filed: Dec. 14, 2007

(65) Prior Publication Data

US 2009/0154730 A1 Jun. 18, 2009

(51) Int. Cl.
*H04R 19/02* (2006.01)

(52) U.S. Cl. ..... 381/191; 29/896.23; 381/116

(58) Field of Classification Search ..... 381/116, 381/191; 29/896.23
See application file for complete search history.

(56) References Cited

U.S. PATENT DOCUMENTS

| | | | | |
|---|---|---|---|---|
| 1,762,981 | A * | 6/1930 | Hartley | 381/116 |
| 2,631,196 | A * | 3/1953 | Janszen | 381/116 |
| 3,008,013 | A * | 11/1961 | Walker et al. | 381/182 |
| 3,136,867 | A * | 6/1964 | Brettell | 381/116 |
| 3,833,770 | A * | 9/1974 | Atoji et al. | 381/116 |
| 3,894,199 | A * | 7/1975 | Tamura et al. | 381/116 |
| 3,941,946 | A * | 3/1976 | Kawakami et al. | 381/116 |
| 4,207,442 | A * | 6/1980 | Freeman | 381/116 |
| 4,246,448 | A * | 1/1981 | Tam et al. | 381/111 |
| 6,842,964 | B1 | 1/2005 | Tucker et al. | |
| 7,152,299 | B2 * | 12/2006 | Mango et al. | 29/594 |
| 7,167,130 | B2 | 1/2007 | Hayes | |
| 2005/0024273 | A1 * | 2/2005 | Hayes | 343/702 |
| 2005/0129264 | A1 * | 6/2005 | Mitsuishi | 381/396 |
| 2006/0005876 | A1 * | 1/2006 | Gaudiana et al. | 136/251 |
| 2006/0072770 | A1 * | 4/2006 | Miyazaki | 381/116 |
| 2007/0154035 | A1 * | 7/2007 | Fukui | 381/116 |
| 2009/0154730 | A1 * | 6/2009 | Demuynck | 381/116 |
| 2010/0221617 | A1 * | 9/2010 | Wormald et al. | 429/400 |

FOREIGN PATENT DOCUMENTS

| | | | |
|---|---|---|---|
| EP | 1303164 | A | 4/2003 |
| GB | 2231235 | A | 11/1990 |
| WO | 2007083894 | A | 7/2007 |

OTHER PUBLICATIONS

PCT International Search Report mailed Feb. 5, 2009 for International Application No. PCT/US2008/069924 filed Jul. 14, 2008.

Eaton, William Chris, et al., "Printed Circuit Board for a Flat-Panel Speaker," U.S. Appl. No. 11/956,814, filed Dec. 14, 2007.

* cited by examiner

*Primary Examiner* — Mary Wilczewski
(74) *Attorney, Agent, or Firm* — Coats & Bennett, P.L.L.C.

(57) ABSTRACT

A speaker is integrally formed with a multi-layered printed circuit board. The printed circuit board includes a flexible membrane layer with a conductive pattern thereon. Positive and negative elements are disposed on opposing sides of the flexible membrane. A drive circuit connects to the flexible membrane layer and applies current to the flexible membrane layer responsive to an audio signal to generate audible sounds.

16 Claims, 5 Drawing Sheets

ELECTROSTATIC SPEAKER ARRANGEMENT FOR A MOBILE DEVICE

BACKGROUND

The present invention relates generally to speakers for producing audible sounds and, more particularly, to an electrostatic speaker arrangement for mobile devices.

Advances in communication and manufacturing technologies have resulted in mobile devices, such as mobile telephones and personal digital assistants, becoming increasingly smaller in size. One consequence of these size reductions is that less space is available for speakers and other components. While consumers prefer mobile devices with small form factors, consumers still expect high quality audio output from their mobile devices. Therefore, there is great interest among manufacturers in finding ways to reduce space requirements for speakers while maintaining high quality audio output. At the same time, manufacturers are constantly looking for ways to reduce the cost of mobile devices. Therefore, a significant challenge facing manufacturers is how to make low cost speakers that require less space and that produce high quality audio output.

SUMMARY

The present invention relates to an electrostatic speaker arrangement for mobile devices. The electrostatic speaker arrangement includes a multi-layered printed circuit board. The printed circuit board includes at least one flexible circuit layer with a conductive pattern thereon that functions as the diaphragm of an electrostatic speaker. Positive and negative elements are disposed on opposing sides of the flexible circuit layer. A drive circuit connects to the flexible circuit layer and applies current to the flexible circuit layer responsive to an audio signal. The electrostatic forces move the flexible circuit layer to generate sounds.

In some embodiments, recesses may be formed in the printed circuit board on opposing sides of the flexible circuit layer by removing rigid portions of the printed circuit board. The positive and negative elements may insert into respective recesses. An enclosure may be inserted into one of the recesses to form a sealed speaker cavity on one side of the flexible circuit layer. A speaker grill may be inserted into the other recess.

The speaker arrangement, according to the present invention, may be produced at low cost using components present in the printed circuit board. While low in cost, the electrostatic speaker produces a high quality audio output and reduces space requirements.

DETAILED DESCRIPTION

Figure 1:
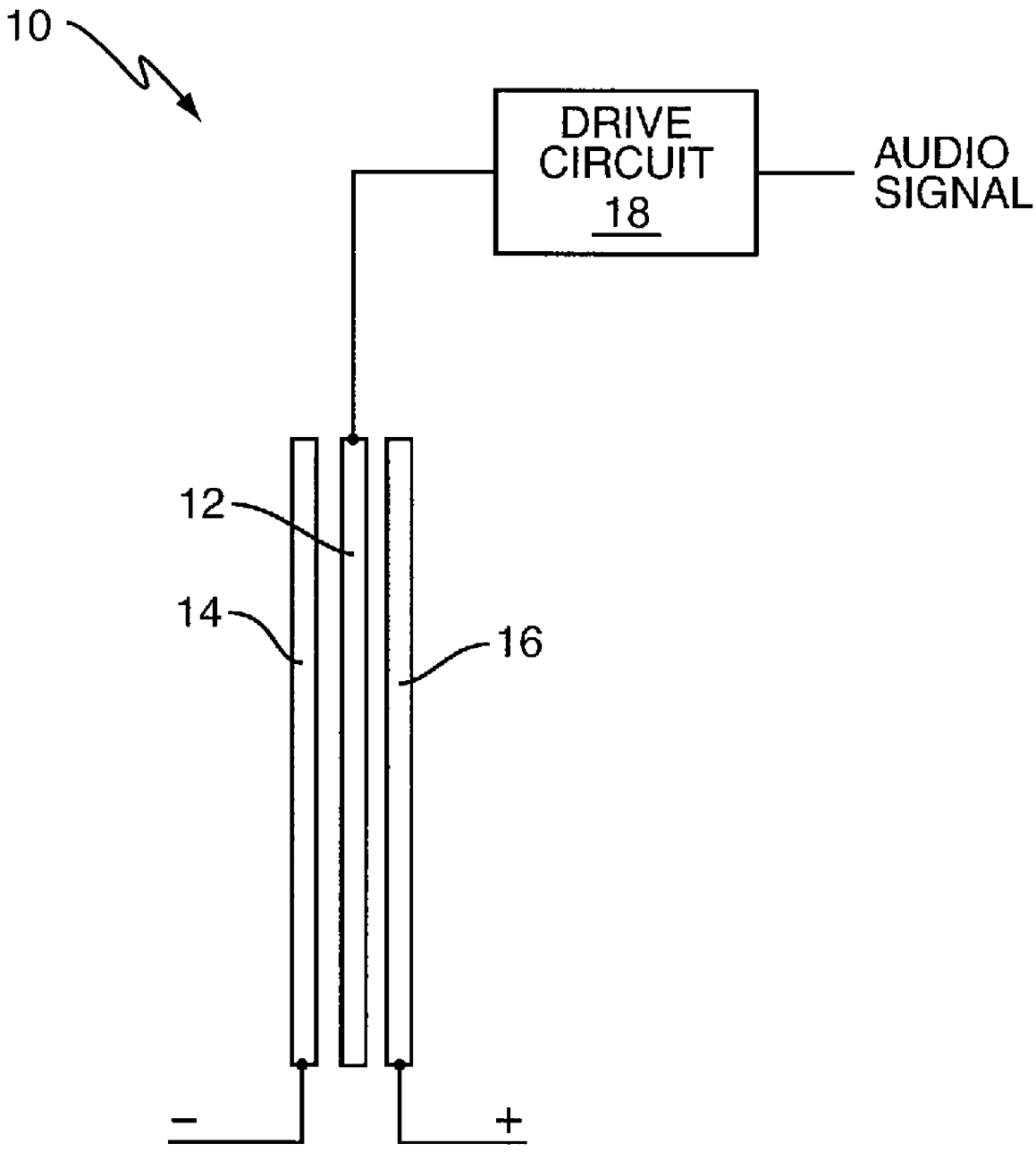
FIG. 1 is a schematic illustration showing the main elements of an electrostatic speaker.
Figure 2:
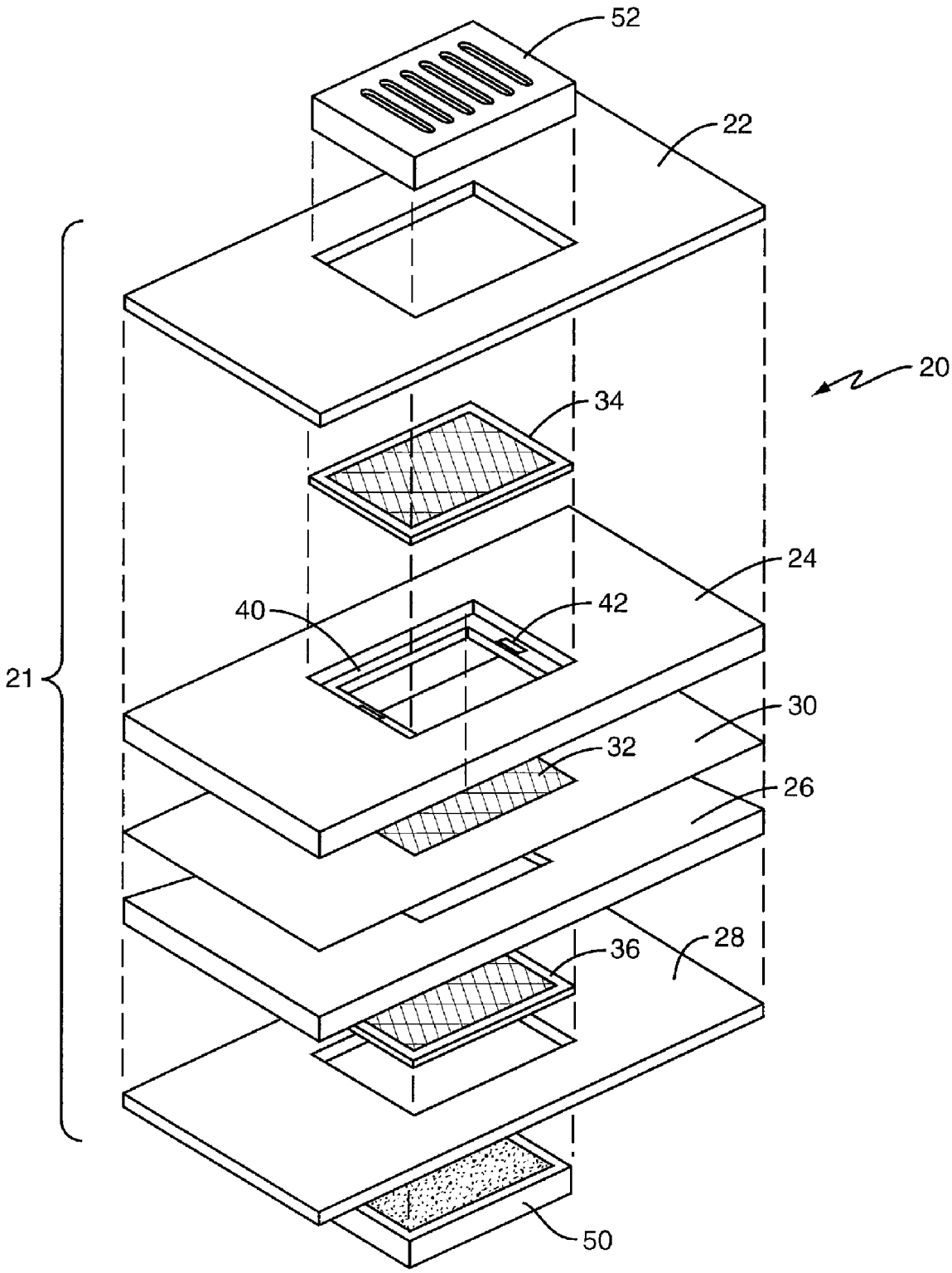
FIG. 2 is an exploded perspective view showing an exemplary electrostatic speaker formed using components of a multi-layered printed circuit board.
Figure 3:
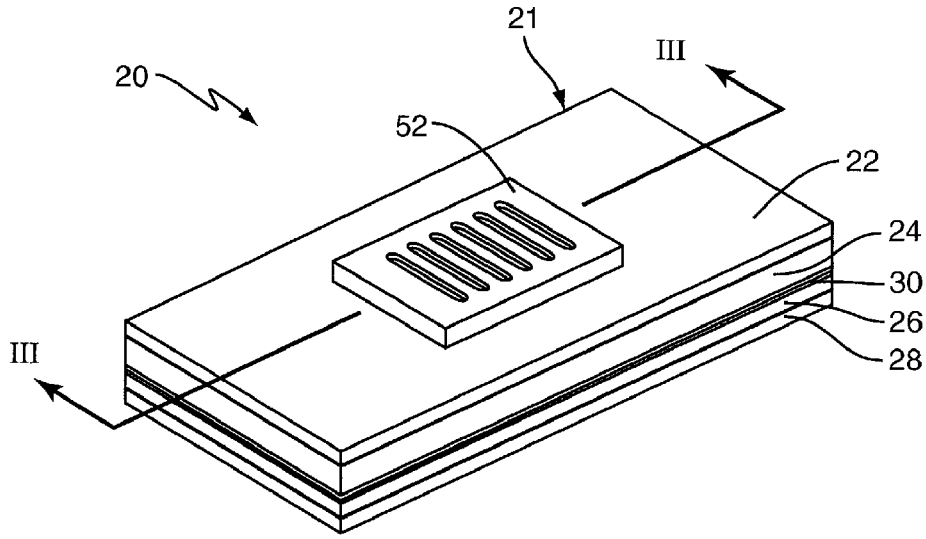
FIG. 3 is a perspective view showing an exemplary electrostatic speaker formed using components of a multi-layered printed circuit board.
Figure 4:
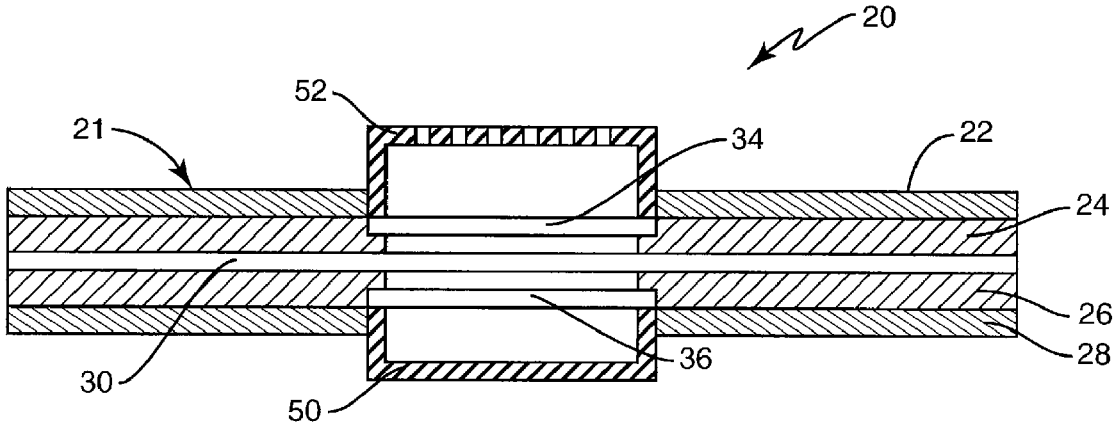
FIG. 4 is a section view of an exemplary speaker arrangement formed using components of a multi-layered printed circuit board.
Figure 5:
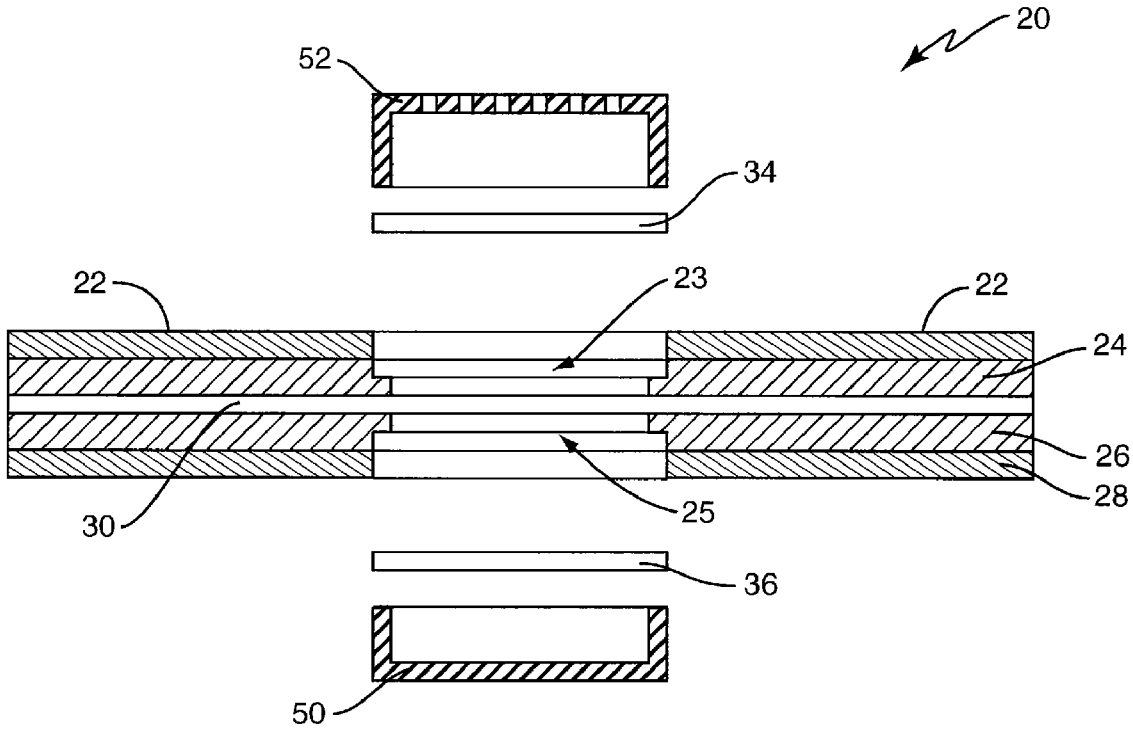
FIG. 5 is a exploded section view of an exemplary speaker arrangement formed using components of a multi-layered printed circuit board.

Referring now to the drawings, FIG. 1 illustrates the main elements of an electrostatic speaker indicated generally by numeral 10. Electrostatic speaker 10 comprises a flexible diaphragm 12 disposed between two elements 14, 16. In the exemplary embodiment, the elements 14, 16 comprise electrically-conductive grids. The elements 14, 16 could also comprise frames that extend along the edges of the diaphragm 12, or perforated plates with openings therein to transmit sound. One element or grid 14 is negatively charged, while the other element or grid 16 is positively charged. A drive circuit 18 applies a drive signal to the diaphragm 12 responsive to an input audio signal. The diaphragm 12 moves toward the positively-charged element 16 when the charge on the diaphragm 12 is negative, and moves toward the negatively-charged element 14 when the charge on the diaphragm 12 is positive. The movement of the diaphragm 12 produces audible sounds.

In some embodiments, a constant charge may be applied to the diaphragm 12, while the drive signal is applied to the elements 14, 16. An electrostatic field proportional to the audio signal is produced between the elements 14, 16. The electrostatic force moves the charged diaphragm 12 back and forth to generate audible sounds.

FIGS. 2-5 illustrate an electrostatic speaker 20 constructed using components of a multi-layered printed circuit board 21. The printed circuit board 21 includes five layers 22-30. Layers 22, 24, 26, and 28 are made of a rigid circuit board material. A flexible circuit layer 30 is sandwiched between rigid layers 24 and 26. The flexible circuit layer 30 has a conductive pattern 32 formed thereon and functions as the diaphragm 12 of the electrostatic speaker 20. Portions of the rigid layers 22, 24, 26, and 28 are removed to form recesses 23, 25 on opposite sides of the flexible circuit layer 30. A first conductive grid 34 is inserted into the recess 23 on one side of the flexible layer 30. A second conductive grid 36 is inserted into the recess 25 on the opposing side of the flexible circuit layer 30. The conductive grids 34, 36 function as the positive and negative elements of the electrostatic speaker 20. Conductive grids 34, 36 are spaced far enough from the flexible circuit layer 30 to allow movement of the flexible circuit layer 30 without interference. In some embodiments, the conductive grids 34, 36 may be replaced with magnetic elements.

The rigid layers 24, 26 of the printed circuit board may include outwardly-facing surfaces or lands 40. The lands 40 may have electrical contacts or pads 42 to establish electrical contact between the conductive grids 34, 36 and the printed circuit board 21. Alternatively, conductive leads extending from the conductive grids 34, 36 may be surface mounted to the printed circuit board 21.

An enclosure 50 inserts into the recess 25 on one side of the printed circuit board 21. The enclosure 50 retains the conductive grid 36 and forms an enclosed speaker cavity on one side of the flexible circuit layer 30. A speaker grill 52 inserts into a recess 23 on the opposite side of the printed circuit board 21. The speaker grill 52 retains the conductive grid 34 and includes acoustic ports for emitting sounds generated by the electrostatic speaker 20. The enclosure 50 and speaker grill 52 may include mechanical features to retain the enclosure 50 and speaker grill 52 in respective recesses 23, 25.

Figure 6A:
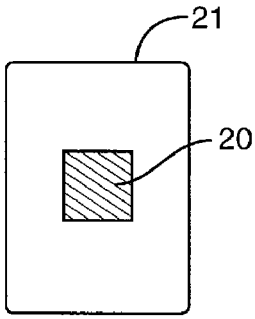
FIGS. 6A and 6B illustrate various ways to position the speaker relative to the area of a printed circuit board.
Figure 6B:
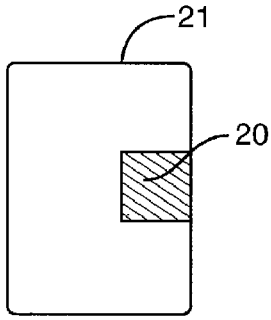

FIGS. 6A and 6B illustrate possible locations of the electrostatic speaker 20 relative to the area of a printed circuit board 21. In FIG. 6A, the electrostatic speaker 20 is located in an interior area of the printed circuit board 21. In this embodiment, the enclosure 50 and speaker grill 52 are inserted from above and below the flexible circuit layer 30, respectively. In FIG. 6B, the electrostatic speaker 20 is located along one edge of the printed circuit board 21. Recesses 23, 25 are open along the edge of the printed circuit board 21 to allow the enclosure 50 and speaker grill 52 to slide sideways into respective recesses 23. 25.

In operation, a positive charge is applied to conductive grid 34 and a negative charge is applied to conductive grid 36. Those skilled in the art will appreciate, however, that the positive and negative charges could be reversed. A drive circuit 18 as shown in FIG. 1 applies a drive signal to the conductive pattern 32 on the flexible circuit layer 30 responsive to an input audio signal. The drive signal causes the current in the conductive pattern 32 to vary. When the current is negative, the flexible circuit layer 30 moves toward the positive conductive grid 34. Conversely, when the current is positive, the flexible circuit layer 30 moves toward the negative conductive grid 36. The movement of the flexible circuit layer 30 generates sound waves which emit through the acoustic ports in the speaker grill 52.

Figure 7:
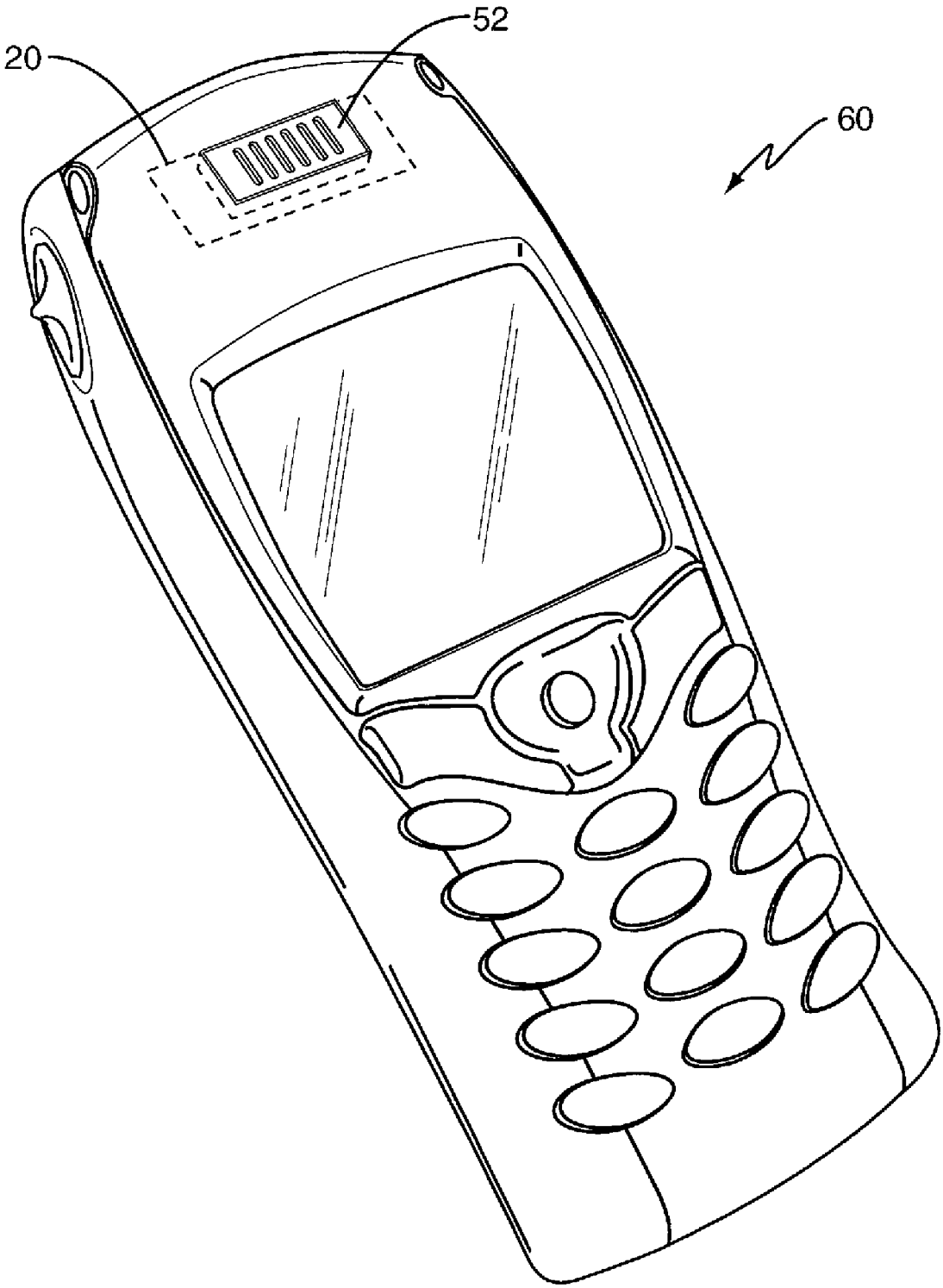
FIG. 7 illustrates an exemplary mobile telephone having an electrostatic speaker according to the present invention.

The electrostatic speaker 20 may be used in a mobile device, such as a mobile telephone. FIG. 7 illustrates a mobile telephone 60 having an electrostatic speaker 20 as hereinabove described. The electrostatic speaker 20 may also be used in personal digital assistants (PDAs), portable audio/video players, and other electronic devices that require a speaker to output sounds.

The present invention provides a method of fabricating an electrostatic speaker 20 using components of a printed circuit board 21. More particularly, a flexible circuit layer 30 in the printed circuit board 21 functions as the diaphragm 12 of the electrostatic speaker 20. The conductive grids 34, 36 could also be made of flexible circuit layers. The entire speaker assembly may be produced at very low cost without sacrificing sound quality. Further, the arrangement reduces the overall thickness of the mobile device by using some of the area in the printed circuit board 21 as speaker cavities.

The present invention may, of course, be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A speaker for a mobile device comprising:

a multi-layered printed circuit board including at least one flexible membrane layer having a conductive pattern formed thereon;

a positive element disposed on a first side of said flexible membrane layer and a negative element disposed on a second side of said flexible membrane layer; and a drive circuit electrically connected to said flexible membrane layer to apply current to said flexible membrane layer responsive to an input audio signal to produce audible sounds.

2. The speaker of claim 1 wherein said printed circuit board includes a first recess on a first side of said flexible membrane layer respectively to receive one of said positive and negative elements.

3. The speaker of claim 2 wherein said printed circuit board includes a second recess on a second side of said flexible membrane layer respectively to receive one of said positive and negative elements.

4. The speaker of claim 3 wherein said first and second recesses are open along one edge of said printed circuit board to allow lateral insertion and removal of said positive and negative elements into said first and second recesses respectively.

5. The speaker of claim 3 further comprising an enclosure insertable into one of said first and second recesses to form a sealed speaker cavity.

6. The speaker of claim 5 further comprising a speaker grill insertable into one of said first and second recesses.

7. The speaker of claim 1 wherein at least one of said positive and negative elements comprises a conductive grid.

8. The speaker of claim 1 wherein at least one of said positive and negative elements comprises a magnetic element.

9. A method of making a speaker comprising:

forming a multi-layered printed circuit board including a flexible membrane layer with a conductive pattern;

disposing positive and negative elements on opposing sides of said flexible membrane layer; and connecting a drive circuit to said flexible membrane layer, wherein said drive circuit is operative to drive said flexible membrane layer responsive to an input audio signal to produce audible sounds.

10. The method of claim 9 further comprising forming a first recess on a first side of said flexible membrane layer respectively to receive one of said positive and negative elements.

11. The method of claim 10 further comprising forming a second recess on a second side of said flexible membrane layer respectively to receive one of said positive and negative elements.

12. The method of claim 11 wherein said first and second recesses are open along one edge of said printed circuit board to allow lateral insertion and removal of said positive and negative elements into said first and second recesses respectively.

13. The method of claim 11 further comprising inserting a back enclosure into one of said first and second recesses to form a sealed speaker cavity.

14. The method of claim 13 further comprising inserting a speaker grill into one of said first and second recesses.

15. The method of claim 9 wherein at least one of said positive and negative elements comprises a conductive grid.

16. The method of claim 9 wherein at least one of said positive and negative elements comprises a magnetic grid.

* * * * *